United States Patent [19]

Krech et al.

[11] Patent Number: 4,521,129

[45] Date of Patent: Jun. 4, 1985

[54] ELASTOMERIC PAVEMENT MARKER HAVING IMPROVED CONFIGURATION

[75] Inventors: Thomas D. Krech, Cottage Grove; David C. May, Stillwater, both of Minn.

[73] Assignee: Minnesota Mining and Manufacturing Company, Saint Paul, Minn.

[21] Appl. No.: 505,382

[22] Filed: Jun. 17, 1983

[51] Int. Cl.[3] ..... E01F 9/06

[52] U.S. Cl. ..... 404/10; 404/16

[58] Field of Search ..... 404/10, 11, 9, 12–16; 350/105, 99, 97, 107; 116/63 R

[56] References Cited

U.S. PATENT DOCUMENTS

| | | | |
|---|---|---|---|
| D. 236,818 | 9/1975 | Stenemann | D10/111 |
| 1,707,951 | 4/1929 | Schleicher | 404/10 |
| 1,755,443 | 4/1930 | Hartzler | 404/10 |
| 1,766,073 | 6/1930 | Hartzler | 404/10 |
| 1,833,124 | 11/1931 | Rand | 404/10 |
| 1,888,590 | 11/1932 | Greenlee | 404/11 |
| 1,994,027 | 3/1935 | Poston | 404/11 |
| 3,340,779 | 9/1967 | Mahoney | 404/10 |
| 3,785,719 | 1/1974 | Jonnes | 350/105 |
| 3,830,582 | 8/1974 | Rimell | 404/11 |
| 3,879,148 | 4/1975 | Eigenmann | 404/10 |
| 3,963,362 | 6/1976 | Hollis | 404/10 |
| 4,035,059 | 7/1977 | DeMaster | 350/105 |
| 4,111,581 | 9/1978 | Auriemma | 404/10 |
| 4,187,131 | 2/1980 | Shortway et al. | 428/159 X |

FOREIGN PATENT DOCUMENTS

| | | | |
|---|---|---|---|
| 58-98507 | 6/1983 | Japan . | |
| WO82/01730 | 5/1982 | PCT Int'l Appl. . | |
| 1372878 | 9/1971 | United Kingdom | 404/10 |

*Primary Examiner*—James A. Leppink
*Assistant Examiner*—Beverly E. Hjorth
*Attorney, Agent, or Firm*—D. M. Sell; J. A. Smith; D. B. Little

[57] ABSTRACT

Flexible, raised pavement markers having improved shapes which take advantage of relief cuts and ribs to increase the durability and retention of reflectivity. One embodiment of such a marker comprises: a flexible body made of sponge rubber and having a raised surface connected to a base portion through a connecting portion, a reflective film attached to the raised portion, and a pressure-sensitive adhesive on the base. Relief cuts along the back of the connecting portion provide a bending or folding action whereby the reflective film is made to lie flat when a tire passes over the marker, thus protecting the reflective sheeting from scuffing.

10 Claims, 3 Drawing Figures

ELASTOMERIC PAVEMENT MARKER HAVING IMPROVED CONFIGURATION

TECHNICAL FIELD

This invention pertains to pavement markers used in delineating traffic lanes on highways.

BACKGROUND

Historically, pavement markings have fallen into three basic classes:

(1) Painted lines having glass spheres embedded in a polymeric material to provide some degree of retroreflection;

(2) Preformed tapes comprised of polymeric film having an adhesive on one side and a layer of glass spheres on the other; and (3) Raised pavement markers providing discrete points of a retroreflective material.

Raised pavement markers offer a greater degree of night delineation or retroreflection, wet or dry, than is offered by painted lines and tapes. Most commercial forms of raised lane delineators comprise a flat-bottomed disk or base (ceramic, polymeric or metal) having a raised portion which carries a reflector portion made of reflective glass microspheres or cube-corner reflector inserts. After the passage of time, these devices can move or slide out of position under the repeated impact of vehicle wheels.

Raised markers or delineators have found wide application in road markings, but their application would be even wider except for some disadvantages, specifically: cost (more expensive than tape or reflective paint), poor durability (broken upon impact, scratched, etc.) and placement, requiring curing glues (epoxy), holes or anchors to remain in place. In geographic areas in which roadways must be plowed to clear them of snow, such lane delineators are removed by the plowing operation. Furthermore, raised markers made of a hard or heavy material could cause property damage and injury if they were thrown into the air by a snowplow, e.g., breaking a passing motorist's windshield.

Some known pavement markers have a raised rubber reflecting portion or tab which is intended to bend over under a vehicle tire. Others have a reflecting portion which is supposed to retract into a recess in the pavement. The former type is illustrated by U.S. Pat. Nos. 4,111,581; 3,963,362; 3,879,148; and 3,785,719. In all of these patents, the reflecting portion is a flat reflectorized rubber piece or tab rising above the pavement surface. The tab is supported at its bottom by attachment to the base portion. These designs suffer from at least two disadvantages: a. fatigue at the joint between the reflecting tab and the base (causing the tab to fail to recover to its intended position or to simply lie flat); and b. creasing or breaking of the reflector due to the flexing of the tab at some point inbetween its top and the base. The forces exerted by a moving vehicle tire on a pavement marker are complex and change as the tire traverses the marker. Vertical tab markers actually tend to crimp or bend in the middle before bending near the base.

Markers having reflecting surface tabs oriented at an obtuse angle to the road surface, tend to lose reflectivity rapidly due to the action of dirt and grit as tires pass over the reflector.

The object of this invention is a raised pavement marker offering a high degree of reflectivity which is retained for a long time, low cost, ease of placement, improved durability, and safety while alleviating the support and creasing problems of prior raised rubber markers.

DISCLOSURE OF INVENTION

A roadway marker is provided which comprises a body:

(a) made of an elastomer having a compressive strength at 25% compression of about 40 to 100 kilo Pascals;

(b) having a base portion with an approximately flat bottom which can be attached to a road;

(c) having a raised surface adapted to face oncoming traffic when the marker is mounted on a road, to which surface is attached a reflective material; and (d) having a shape which supports the raised surface through a connecting portion of the body extending between the back of the raised surface and the base portion, said connecting portion forming an acute angle with the plane of the bottom of the base portion and having at least two ribs located on the back side of said connecting portion which ribs are oriented parallel to the plane of the base portion.

Compressive strength is measured by ASTM test specification D1056.

An alternative embodiment to meet the objectives stated above comprises a body with features (a) and (b) above but having:

(c) a portion with a diamond-shaped cross-section oriented such that at least one of its surfaces is a raised surface adapted to face oncoming traffic when the marker is mounted on a road, to which raised surface is attached a reflective material; and (d) at least one protective rib forming a part of the base, which rib together with the rest of the base defines a depression into which the diamond-shaped portion is folded approximately flat under the load of a vehicle wheel, the top of the diamond-shaped portion being about as high as or lower than the top of the protective rib when under such load.

The marker should be placed so that the protective rib is on the side facing oncoming traffic. The height of the protective rib is generally a minimum of 45% of the height of the diamond-shaped portion, as measured from the bottom of the base. However, it should not be so high as to obscure the reflecting material. The ribs are believed to protect the diamond shaped portion from stress concentration which would hasten its deterioration. Thus the protected diamond shape should have a longer service life.

Physically, all raised pavement markers (except those which retract into holes in the road) exert sufficient force to actually raise vehicles travelling over them some finite height. The greater this height becomes, the more force is exerted upon the marker by each vehicle which is forced to deviate from its path. The use of cellular elastomers (sponge rubbers) for the body minimizes this force since they compress well. The uncompressed marker height is normally in the range of 6 mm to 25 mm, and is preferably no greater than 20 mm. The body of the above described markers deforms to position the raised reflecting surface (or the reflecting surface of the diamond-shaped portion described above) approximately parallel to the base portion under a load of at least about 100 kPa.

A retroreflective film may be applied to the raised surface as the reflective material to provide the desired reflective properties.

These markers may also utilize pressure-sensitive adhesive on the bottom for adhering to the road surface, making their placement very easy by simply pressing them to the surface.

The marker bodies can be produced in continuous extruding equipment rather than individually in molds. The polymeric body is extruded and cut to the desired length. The pressure-sensitive adhesive and reflective sheeting can also be applied by continuous means.

No recess or hole in the roadway is required, as is the case with many other types of pavement markers.

Compression of the marker body material itself is a significant contributing factor to the deformation of the marker under the vehicle wheel, in addition to bending which seems to be the major mode of deformation in known deformable pavement markers. Even solid rubber markers do not generally compress as well as cellular polymers.

The type of raised pavement markers disclosed herein may be produced at very low cost, thereby allowing placement of a series of numerous markers so drivers would see a continuous stripe along the road. Where reflector height is 9.5 mm and viewing distance is about 61 meters the markers should be placed at about 760 mm intervals for reflecting from automobile headlights.

DETAILED DESCRIPTION OF THE INVENTION

Figure 1:
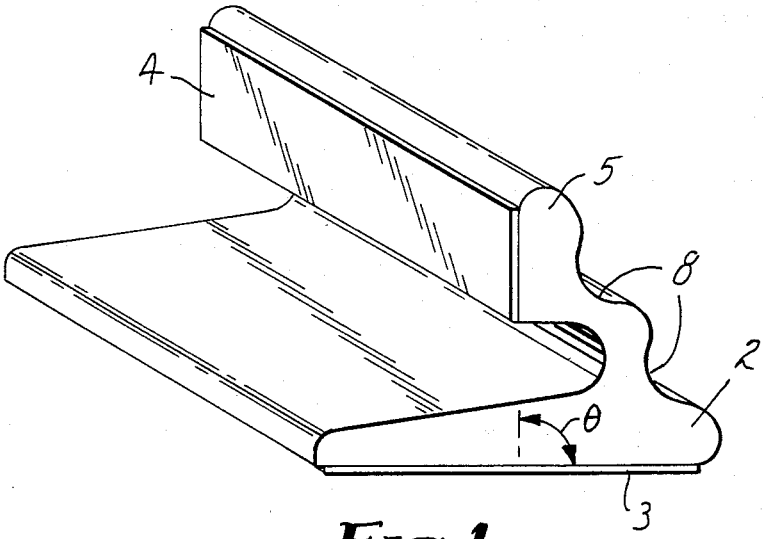
FIG. 1 is a perspective view of one embodiment of the pavement markers of this invention.
Figure 2:
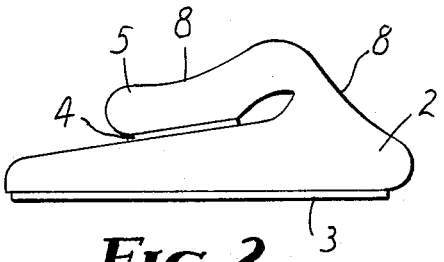
FIG. 2 is an elevation view of the pavement marker of FIG. 1 in its compressed state as it would be under the load of a vehicle tire, normally at least about 96 kPa.

FIG. 1 shows the components of one embodiment of this invention. Item 2 is an elastomeric body, for example made of a sponge elastomer such as polyurethane, silicone rubber, ethylene propylene diene terpolymer (EPDM), neoprene or blends of EPDM and neoprene. Adhesive layer 3 is attached to the base of the body, and reflecting material 4 is attached to the raised reflecting surface portion 5 of the body. A surprisingly small amount of adhesive is necessary to hold these flexible foam markers on the road (e.g., peel strength of 4.2 pounds per inch, 0.74 kN/m). The angle $\theta$ between the reflecting surface and the base (or between the reflecting surface and the road surface) is usually between 45° and 135°, preferably between 45° and 90°.

Reflecting portion 4 is preferably thin retroreflective sheet comprising a polymeric support sheet in which a monolayer of transparent microspheres or beads is embedded to slightly more than half their diameter. The glass beads carry a coating of reflective material such as aluminum over their embedded surfaces. The reflector support sheet has a layer of adhesive on the back by which it is adhered to the pavement marker body as shown. For wet reflection, enclosed lens sheeting appears to perform best (i.e., glass beads covered by a clear polymer layer) although an exposed lens sheeting and cube corner reflectors may also be used.

Reinforcement may be used within the body (e.g., fiberglass fabric or fibers) to strengthen the markers.

As mentioned earlier, the pavement marker bodies of this invention can be made by an extrusion process. The manufacture of cellular or sponge rubbers in an extrusion process is known. The uncured elastomer is generally compounded with vulcanizing chemicals and a blowing agent at a temperature below the decomposition temperature of the blowing agent. A suitable EPDM sponge rubber is described in Borg, E. L., "Ethylene/Propylene Rubber", in *Rubber Technology*, 2d ed., Morton, M. ed., Van Nostrand Reinhold Company, New York, 1973, at pages 242 and 243, which is incorporated herein by reference. Further description of sponge rubber is found in Otterstedt, C. W., "Closed Cell Sponge Rubber", in *The Vanderbilt Rubber Handbook*, R. T. Vanderbilt Co., Inc., Norwalk, Conn., 1978, at pages 728–729 which is also incorporated by reference herein.

The compound is extruded through a die of specified shape. The extrudate is then cured and simultaneously expanded at elevated temperature. Curing may be done in a brine bath at about 204° C.

After the body material extrudate has been cured, a reflective (preferably retroreflective) film is applied with a pressure sensitive adhesive to the body surface adapted to face oncoming traffic. The retroreflective film is preferably of the type known as wide angle flat top sheet which comprises: a back reflector; an overlying transparent matrix; a light-returning layer of small transparent spheres embedded in the transparent matrix in optical connection with the back reflector but spaced from it a distance to increase substantially the brilliance of reflected light; and a transparent overlying solid covering and conforming to the front extremeties of the spheres and having a flat front face. Such sheeting reflects a cone of light back toward a light source, even though the incident beam strikes the sheeting at an angle other than perpendicular to the sheeting. One patent on the subject of such sheeting is U.S. Pat. No. 2,407,680. The transparent film occupying the space between the spheres and the reflector is called the spacing film. This wide angle flat top sheeting can be considered an enclosed lens sheeting having a spacing film with a thickness which locates the back reflector at the approximate focal point of the optical system.

Finally, an adhesive is applied to the bottom surface of the marker body. Preferably, it is a phenolic modified polybutadiene pressure sensitive adhesive at least about 250 microns thick cast on a disposable (paper) liner. The liner is removed prior to placement of the marker on the road surface.

The markers may be applied to the road by at least two methods. One such method is removing the adhesive liner and pressing the marker to the road surface or onto other marking materials (tape or paint). A second method comprising applying the markers to a tape which is thereafter applied to the road.

Figure 3:
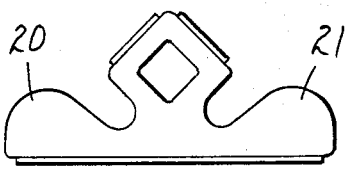
FIG. 3 is a cross-section of the embodiment of these pavement markers called the protected diamond shape.

One hollow version of this invention is the protected diamond cross-section of FIG. 3. The diamond-shaped portion is joined to the base along the line defined by one of the corners of the diamond shape and is oriented so that at least one of its surfaces is a raised surface adapted to face oncoming traffic. In that embodiment the reflecting layer is adhered to at least one such surface.

The shape of these markers contributes to their durability and can help prolong reflectivity. To increase durability, marker shapes of this invention provide some form of lateral or back support for the raised surface or reflector, unlike the markers with raised reflective rubber tabs discussed in the background section. The body has a connecting portion which joins the base and the back side of the raised surface which it supports. For example, the marker of FIG. 1 supports the whole back of the reflector 4 with raised body portion 5. The reflecting portion is not simply a thin pliable tab in the roadway, as with the older designs.

In the protected diamond shape of FIG. 3, the back of the reflecting surface is inherently supported at the top and bottom by the portions of the diamond that connect to it at an angle. The two protective ribs 20 and 21 running parallel to and on opposite sides of the elongated sides of the diamond extend the life of the markers over that of similar designs without the ribs. The aspect ratios (width at the widest point divided by height) for the diamond shape and the ribs are preferably in the ranges of 0.6 to 1.0 and about 1 to 1.3 respectively. Height of the diamond shape is measured from the point where it joins the base, and height of the ribs is measured from the bottom of the marker.

As mentioned in the background section, there is also a tendency of flat reflectors to flex in the middle under vehicle loading. Certain design factors shown in the drawings are helpful in avoiding this tendency and cause the reflecting portion of the marker to lie flat (protecting it from scuffing in the case of the design shown in FIG. 1). These features are: a. the rounding of corners; b. the relief cuts shown, such as those labelled number 8 between the ribs on the back of the connecting portion in FIG. 1.

The reflecting portions of these markers lie flat under a vehicle tire which represents a load of at least 96 kPa. This characteristic is obtained using the sponge rubbers described previously. It can also be attained by using normal vulcanized rubbers in a hollow configuration.

The invention will be further clarified by a consideration of the following example which is intended to be purely exemplary.

The pavement markers of this invention and two other types of markers were tested in a wear simulator. The wear simulator used in evaluating the roadway markers of this invention was an apparatus which comprised a segmented, circular, vertical race or track about 4.25 meters in diameter, and a pair of mechanical arms, each being supported by a hub at the center of the circular race and both located along the same diameter of the circle. Each of the 36 segments in the race was a concrete block (about 102×305×305 mm in dimension) mounted vertically around the perimeter and intended to hold at least one sample of the article being tested. On the end of each mechanical arm nearest the track was mounted a wheel on which a vehicle tire was installed. The mechanism comprising the mechanical arms and wheels rotated about the center of the test track by means of a 25 horsepower electric motor causing the tires to roll in a circular path against the surface of the track. Each pass of a wheel over a test specimen was counted. The speed (rotations per minute) could be varied in the range of 0 to about 31 meters per second by means of a speed control on the motor. Load applied to the tires could also be controlled by means of an air cylinder attached to both the mechanical arm and the beam or bracket holding each wheel. For the tests reported herein, wheel speed was equivalent to about 18 m/sec. (41 miles/hr), and load applied to the markers by the wheels was about 4200 Newtons (950 pounds force).

In the table below, all of the markers tested were made of cellular neoprene (the preferred polymer) having a wide angle flat top reflective sheeting on the raised reflecting surface and a pressure sensitive adhesive on the bottom of the base for attachment to the test track. In each case, the transparent matrix of the reflective sheeting was a polyurethane.

Controls numbers 1 and 2 were raised pavement markers having a generally similar configuration to FIG. 1 except that the ribs on the back side of the connecting portion were missing. The samples labelled "Hollow diamond" were generally similar in shape to FIG. 3 except that the protective ribs were missing, and the base was generally flat.

The samples were placed in the wear simulator and subjected to numerous impacts or hits by the tires traveling around the test track. The wear simulator was stopped at intervals (denoted by the number of hits or impacts by the vehicle tires on the markers). Two properties are desired: 1. Overall durability of the marker affected by cracking and deterioration of the body or the reflector, and 2. Retention of reflectivity by the reflective sheeting after sustaining numerous impacts.

| | | OBSERVATIONS<br>Hits - Number of Vehicle Tire Impacts on the Markers | | | | | | | |
|---|---|---|---|---|---|---|---|---|---|
| Sample | Body Type | 14,852 | 25,238 | 34,817 | 44,825 | 65,051 | 116,518 | 318,112 | 350,342 |
| 6A | Control 1 | Reflective Sheeting Crease, | Some body wear on back | Sheeting Dirty, No Cracks | NC | SP - small body piece torn off | BC Reflective | 10% of sheeting gone, | |
| 6B | Control 2 | Sheeting Crease | SC-some wear on body back | Sheeting dirty and cracked | NC | | Sheeting worn on bottom | Deep Pockets in back | |
| 7A | FIG. 1 | NC | NC | NC | Some body wear on back | NC, No cracks | More body wear on back | F, raised body portion torn off | |
| 7B | FIG. 1 | NC | NC | Slight body abrasion | | | | after 201,594 hits | |
| 8A | Hollow Diamond | Reflective sheet dirty | SC | BC & PC Body corner | NC | Larger cracks on body | Crack propagated through body | F 25% sheeting gone | |
| 8B | Hollow Diamond | SC-Reflective sheet dirty & cracked | NC | cracks, 1.6 mm height loss | NC | | | Body split | |
| 10A | FIG. 3 | SC | BC | Worse body Cracking | NC | Worn rib, dirty sheeting, | NC | NC | PC 1.6 mm |

-continued

| | | OBSERVATIONS Hits - Number of Vehicle Tire Impacts on the Markers | | | | | | | |
|---|---|---|---|---|---|---|---|---|---|
| Sample | Body Type | 14,852 | 25,238 | 34,817 | 44,825 | 65,051 | 116,518 | 318,112 | 350,342 |
| 10B | FIG. 3 | SC & BC | BC | | NC | body cracks | NC | NC | PC 1.6 mm |

NC means no, or very little, perceptible change
SC means reflective sheeting cracked
BC means body cracked
PC means profile change, visually lower probably due to fatigue
SP means spalling
F means failure - i.e. rupture of the body or loss of reflective sheeting The marker of FIG. 1 (samples 7A and B) retained its reflectivity without significant decrease until it failed after about 201,594 hits. On the other hand, although the body of Controls 1 and 2 outlasted that of samples 7A and 7B, the markers had essentially lost their usefulness because part of the reflector sheeting had been torn off and that remaining had lost most of its reflectivity. Sheeting cracks, body cracks, and spalling occurred in controls 1 and 2 long before they did in the marker of FIG. 1.

The marker of FIG. 3 experienced some loss of reflectivity, some cracking in the sheeting and the body and some profile change, but it remained intact and functional throughout the course of the wear test.

On the other hand, the unprotected hollow diamond configuration failed after 318,112 hits.

Other embodiments of this invention will be apparent to those skilled in the art from a consideration of this specification or practice of the invention disclosed herein. Various omissions, modifications and changes to the principles described herein may be made by one skilled in the art without departing from the true scope and spirit of the invention which is indicated by the following claims.

What is claimed is:

1. A pavement marker comprising a body:

(a) made of an elastomer having a compressive strength at 25% compression of about 40 to 100 kilopascals;

(b) having a base portion with an approximately flat bottom which can be attached to a road without using either an anchor or a recess in the pavement;

(c) having a raised surface adapted to face on-coming traffic when the marker is mounted on a road, to which surface is attached a reflective material; and (d) having a shape which supports the raised surface through a connecting portion of the body extending between the back of the raised surface and the base portion, said connecting portion forming an acute angle with the plane of the bottom of the base portion and having at least two ribs located on the back side of said connecting portion which ribs are oriented parallel to the plane of the base portion.

2. The pavement marker of claim 1 wherein the elastomer is comprised of a cellular polymer.

3. The pavement marker of claim 2 in which the elastomer is selected from the group consisting of polyurethane, silicone rubber, neoprene rubber, ethylene propylene diene terpolymer, and blends of neoprene and ethylene propylene diene terpolymer.

4. The pavement marker of claim 1 characterized in that the body deforms to position the raised surface approximately parallel to the base portion under a load of at least about 100 kilo Pascals.

5. A pavement marker comprising a body:

(a) made of an elastomer, having a compressive strength at 25% compression of about 40 to 100 kilopascals;

(b) having a base portion which can be attached to a road without using either an anchor or a recess in the pavement;

(c) a portion of which body has a diamond-shaped cross section which is oriented such that at least one of its surfaces is a raised surface adapted to face oncoming traffic when the marker is mounted on a road, to which raised surface is attached a reflective material; and (d) having at least one protective rib forming a part of said base, which rib together with the rest of the base defines a depression into which the diamond-shaped portion is folded approximately flat under the load of a vehicle wheel, the top of the diamond-shaped portion being no higher than the top of the protective rib when under such a load.

6. The pavement marker of claim 5 in which the height of the protective rib of part (d) is at least 45% of the height of the diamond-shaped portion but not so great as to obscure the reflecting material.

7. The pavement marker of claim 5 in which the rib has an aspect ratio in the range of about 1 to 1.3, aspect ratio being defined as the ratio of the width at its widest point to the height of the rib.

8. The pavement marker of claim 5 wherein the elastomer is comprised of a cellular polymer.

9. The pavement marker of claim 8 in which the elastomer is selected from the group consisting of polyurethane, silicone rubber, neoprene rubber, ethylene propylene diene terpolymer, and blends of neoprene and ethylene propylene diene terpolymer.

10. The pavement marker of claim 5 which has two protective ribs, one on each side of the diamond-shaped portion.

* * * * *